US005335899A

United States Patent [19]

Golicz

[11] Patent Number: 5,335,899

[45] Date of Patent: Aug. 9, 1994

[54] APPARATUS AND METHOD FOR AUTOMATICALLY ADJUSTING SHEET FEEDING PRESSURE

[75] Inventor: Roman M. Golicz, Clinton, Conn.

[73] Assignee: Roll Systems, Inc., Burlington, Mass.

[21] Appl. No.: 955,334

[22] Filed: Oct. 1, 1992

[51] Int. Cl.[5] ..... B65H 3/04; B65H 1/18

[52] U.S. Cl. ..... 271/34; 271/121; 271/126; 271/149; 271/153; 271/167

[58] Field of Search ..... 271/149, 152, 153, 156, 271/171, 34, 117, 121, 126, 167

[56] References Cited

U.S. PATENT DOCUMENTS

| | | | |
|---|---|---|---|
| 1,396,622 | 11/1921 | Bullen et al. . | |
| 1,912,941 | 6/1933 | Johnson | 271/149 |
| 1,969,946 | 8/1934 | Root . | |
| 2,161,124 | 6/1939 | Babicz . | |
| 2,992,820 | 7/1961 | Tarbuck et al. . | |
| 3,185,472 | 5/1965 | Rubow | 271/149 X |
| 3,240,488 | 3/1966 | Lyman . | |
| 3,683,758 | 8/1972 | Feldkamper . | |
| 3,894,732 | 7/1975 | Müller . | |
| 3,944,213 | 3/1976 | Fallos et al. . | |
| 4,025,068 | 5/1977 | Collins . | |
| 4,039,180 | 8/1977 | Stocker | 271/149 X |
| 4,128,236 | 12/1978 | Lundblad . | |
| 4,177,982 | 12/1979 | Bewersdorf et al. . | |
| 4,268,027 | 5/1981 | Oleksiak et al. | 271/156 X |
| 4,376,530 | 3/1983 | Akai . | |
| 4,397,455 | 8/1983 | Hickey . | |
| 4,500,084 | 2/1985 | McInerny . | |
| 4,607,832 | 8/1986 | Abe . | |
| 4,715,593 | 12/1987 | Godlewski . | |
| 4,744,555 | 5/1988 | Naramore et al. . | |
| 4,871,162 | 10/1989 | Imai et al. . | |
| 4,907,792 | 3/1990 | Washiashi et al. | 271/171 X |
| 4,919,412 | 4/1990 | Weigel et al. | 271/152 X |
| 4,981,292 | 1/1991 | Cosgrove . | |
| 5,104,109 | 4/1992 | Kubo | 271/152 X |

FOREIGN PATENT DOCUMENTS

| | | |
|---|---|---|
| 362404 | 5/1981 | Australia . |
| 1127193 | 7/1982 | Canada . |
| 0115208 | 8/1984 | European Pat. Off. . |
| 1910160 | 3/1968 | Fed. Rep. of Germany . |
| 1957281 | 5/1971 | Fed. Rep. of Germany . |
| 2650564 | 2/1978 | Fed. Rep. of Germany . |
| 3005569 | 9/1980 | Fed. Rep. of Germany . |
| 3508981 | 8/1986 | Fed. Rep. of Germany . |
| 3723589 | 1/1989 | Fed. Rep. of Germany . |
| 59-194950 | 11/1984 | Japan . |
| 424448 | 11/1966 | Switzerland . |
| 544026 | 12/1973 | Switzerland . |
| 2196324 | 4/1988 | United Kingdom . |

OTHER PUBLICATIONS

A. B. Habich & G. M. Yanker, IBM Technical Disclosure Bulletin, vol. 17, No. 7, pp. 1848–1849, Dec. 1974.

*Primary Examiner*—Robert P. Olszewski
*Assistant Examiner*—Boris Milef
*Attorney, Agent, or Firm*—Wolf, Greenfield & Sacks

[57] ABSTRACT

A high speed sheet feeder comprises a support for supporting a stack of sheets. The sheets are driven by a backing plate assembly along the support toward a singulator. The backing plate is driven by a drive member such as a drive chain positioned along the support. The drive chain moves the backing plate in predetermined increments. The singulator is mounted on a bracket that moves in response to pressure exerted by the leading face of the stack thereupon. The increments in which the backing plate moves are varied based upon the degree of movement of the singulator bracket in response to pressure exerted thereupon by the stack. Minimum pressure causes a maximum increment of movement while maximum pressure causes a minimum increment or virtually no movement in the backing plate assembly.

43 Claims, 15 Drawing Sheets

F

APPARATUS AND METHOD FOR AUTOMATICALLY ADJUSTING SHEET FEEDING PRESSURE

FIELD OF THE INVENTION

The present invention relates to a high speed sheet feeder and more particularly to a sheet feeder that automatically adjusts for a wide variation in sheet thicknesses during operation.

BACKGROUND OF THE INVENTION

While high speed sheet feeders have been utilized for many years, their designs have relied generally upon prior knowledge of the exact thickness in size of sheets to be fed. In this manner, the operating parameters of the feeder could be precisely adjusted to account for a particular sheet thickness.

Sheet feeding is a complex process that involves singulation of the downstream most sheet in a stack so that it is no longer frictionally bound to more upstream sheets in the stack. This sheet is then fed at an appropriate time down a feeding path to a location at which it can be utilized. At some point, the stack must be advanced so the next sheet in the stack is brought into position for singulation.

Since the process of feeding involves many variables, there are many points at which failure (e.g. jamming or double feeding of sheets) can occur. Hence, the friction of the singulator, at a degree to which a sheet is singulated away from other sheets in the stack, the exact amount that the stack is advanced and the angle at which the sheet is driven from the stack are carefully controlled. Variations in stack size, thickness and texture of the sheets in the stack can, thus, cause a failure in the feeding process in such prior art devices.

Accordingly, this invention has as one object to provide a high speed sheet feeder that feeds sheets of different thicknesses and textures without need of prior adjustment.

It is another object of this invention to provide a high speed sheet feeder with increased reliability even during high speed operation.

It is yet another object of this invention to provide a high speed sheet feeder that can quickly be adapted to feed sheets either singularly or in an overlapping configuration.

It is yet another object of this invention to provide a high speed sheet feeder that is relatively compact, yet can handle sheets having a variety of sizes.

SUMMARY OF THE INVENTION

A high speed sheet feeder according to this invention features a support structure, that can be adjustable to accommodate different size sheets in a stack. The sheets are positioned on the support structure so that their faces are substantially perpendicular to the base of the support structure. The downstream most end of the stack engages a singulator of a feeding mechanism. The singulator comprising a wheel of frictional material that rotates to drive sheets downwardly out of the stack. The low and downstream of the wheel is positioned a set of belts that engage the driven sheet and drive it further out of the stack. The belts and wheel can be interconnected to rotate simultaneously and at substantially the same speed. A set of output drive rollers, that operate continually, are provided concentrically with lower rollers of the belts. The output drive rollers engage the sheet and drive it fully out of the sheet feeder. The belts are positioned proximate a ramp that insures that only the singulated leading sheet is funneled into the belts. More upstream sheets are remote from the belts and are maintained near or remote, in an upstream direction, from the top of the ramp. The feeding mechanism according to a preferred embodiment of this invention includes an edge detector that deactivates the singulator wheel and belts when the sheet is approximately engaged by the output drive rollers. In this manner, the singulation of the next sheet in the stack is delayed until the preceding downstream sheet has substantially fully exited the feeder. Thus, non-overlapping sheets are generated from the fed stack.

The upstream most portion of the stack includes a backing support that is advanced according to a preferred embodiment by a drive chain. The pressure of the stack against the singulator wheel is precisely maintained by incrementally advancing the backing support. Increments of advance are varied by means of a linkage that interconnects the singulator wheel with a cam and lever arm that move the drive chain. As the stack is biased downstream, the singulator wheel senses the pressure and alters the stroke of the lever arm interconnected with the drive chain so that smaller increments of advance in the drive chain are produced. Hence, the more pressure exerted by the stack on the singulator wheel, the smaller the increments of advance. Conversely, the less pressure exerted by the stack on the singulator wheel, the larger the increments of advance. The linkage, specifically, according to this embodiment includes a stop that raises the lever arm partially out of contact with the cam in order to decrease the period of engagement between the cam and lever arm. This varies the increment value.

BRIEF DESCRIPTION OF THE DRAWINGS

The foregoing and other objects and advantages of the invention will become more clear with reference to the following detailed description of the preferred embodiment as illustrated by the drawings in which.

DETAILED DESCRIPTION

Figure 1:
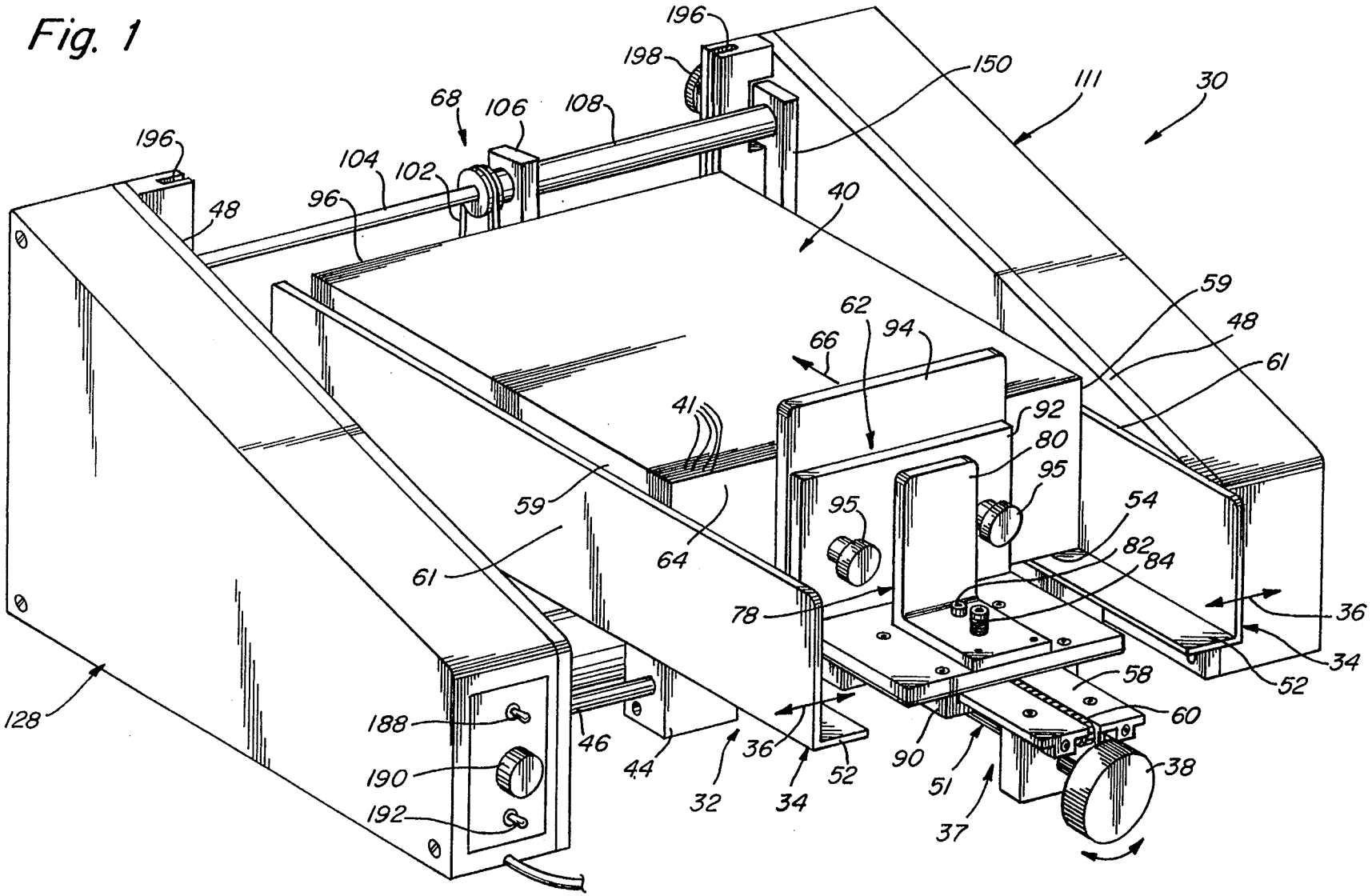
FIG. 1 is a perspective view of a sheet feeder according to this invention.
Figure 2:
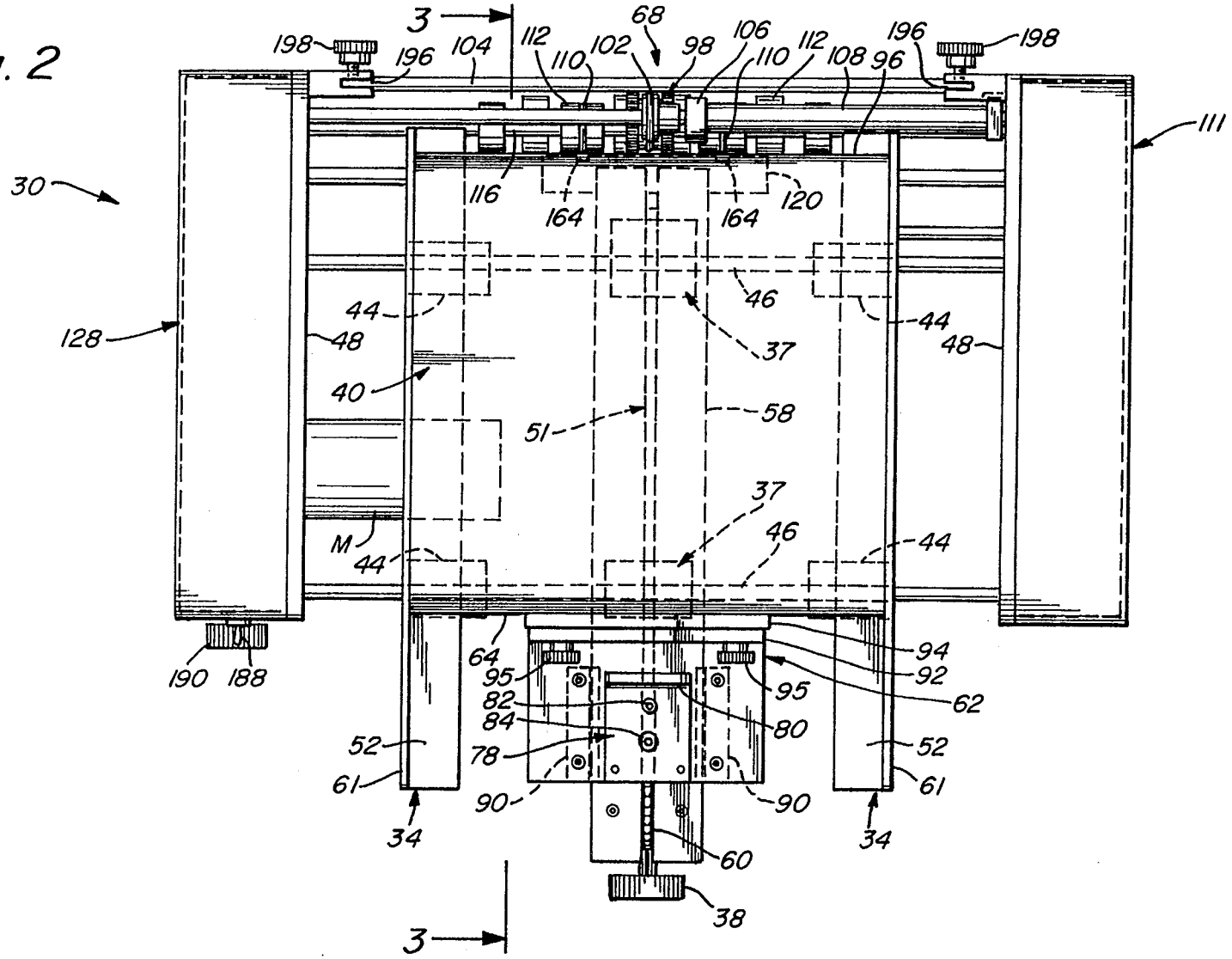
FIG. 2 is a top view of the sheet feeder of FIG. 1.
Figure 3:
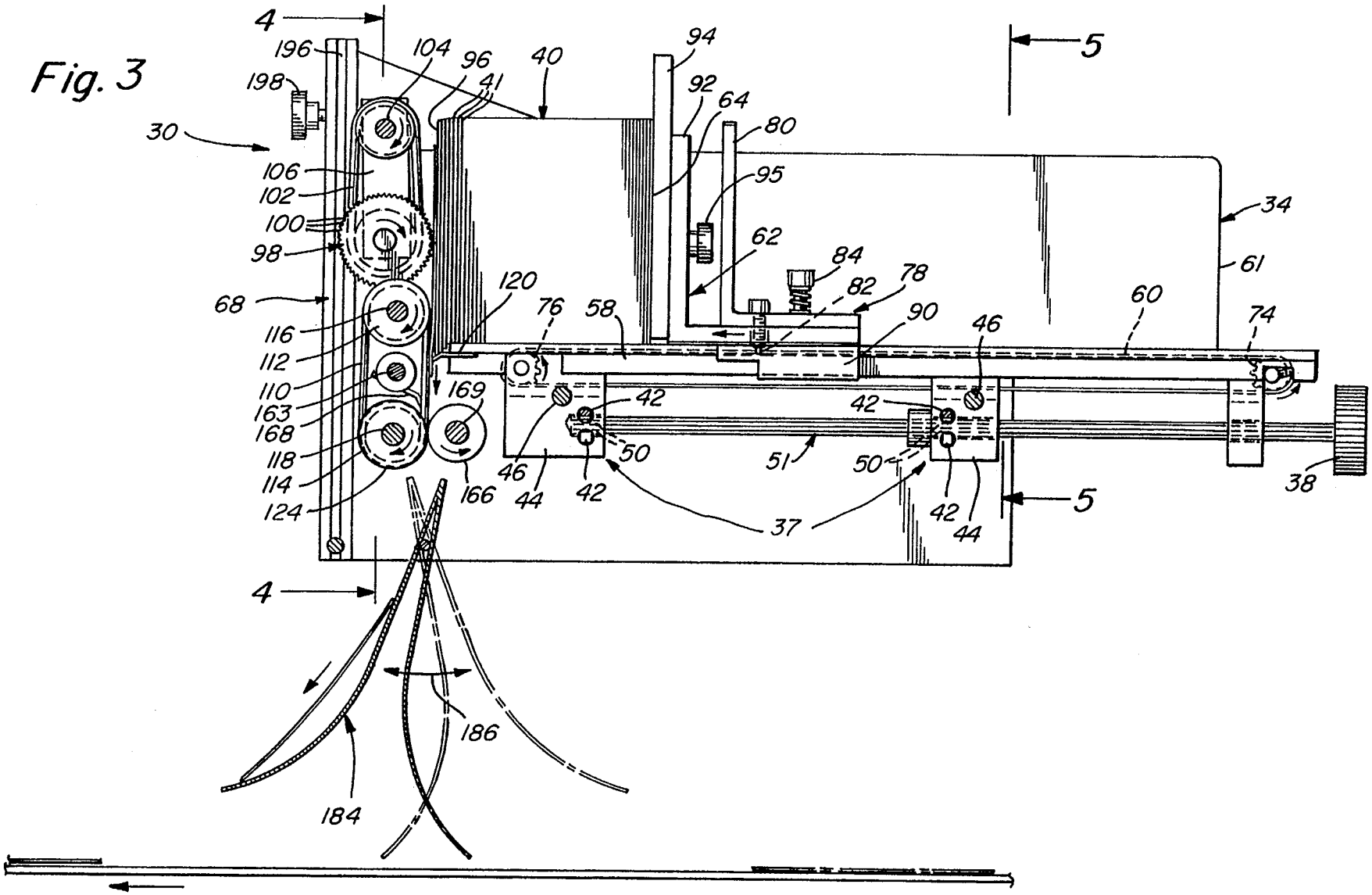
FIG. 3 is a cross-sectional side view of the sheet feeder according to this invention taken along line 3—3 of FIG. 2.

FIGS. 1-3 illustrate a sheet feeder 30 according to the preferred embodiment. The sheet feeder 30 is a free-standing unit, but can be adapted to interface with other mechanisms or can be integrally built into other mechanisms such as printer feed interfaces as disclosed in Applicant's U.S. patent application Ser. No. 07/775,200. It can also be utilized for sorting and counting checks and bank notes.

Figure 5:
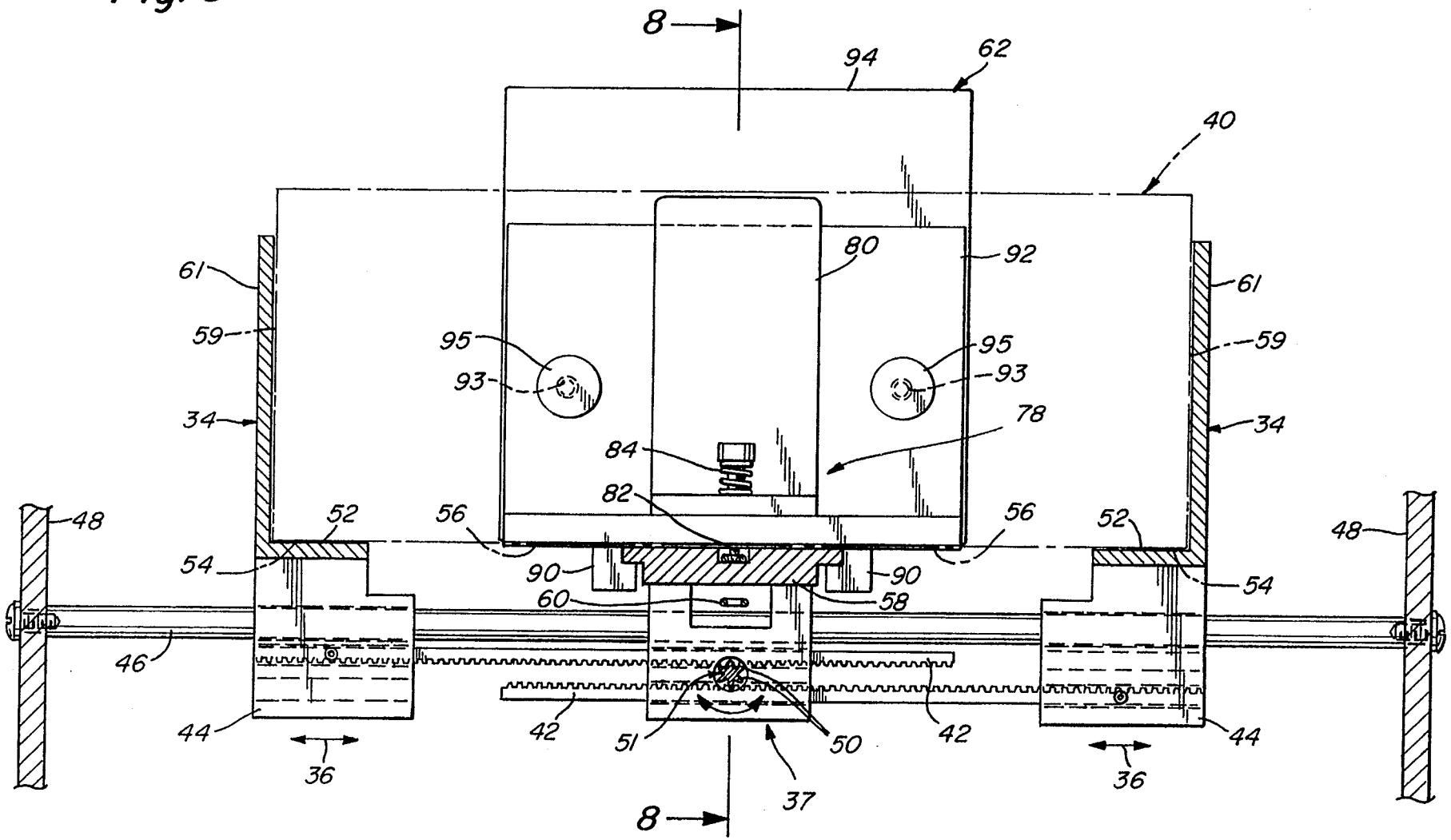
FIG. 5 is a cross-sectional rear view of the sheet feeder taken along line 5—5 of FIG. 3.

The feeder 30 of this embodiment includes a central frame 32 having a pair of L-shaped support plates 34 that are movable widthwise (arrows 36), by means of an adjusting mechanism 37 having a knob 38, to support and guide a stack 40 of sheets 41 of a predetermined size. As detailed in FIGS. 3 and 5, the adjusting mechanism 37 comprises a rack and pinion assembly in which racks 42 are attached to each of the pair of support plates 34. Support plates 34 move on pillow blocks 44 that are, themselves, mounted upon a pair of transverse rods 46 extending between each of the frame side plates 48. Turning the pinion gears 50 via shaft 51 causes the racks 42 to move toward and away from each other at equal distances relative to a center line (line 8—8 of FIG. 5) of the feeder 30.

The support plates 34 include horizontal bases 52 for supporting the outlying bottom edges 54 (FIGS. 1 and 5) of the sheets 41 in the stack 40. The central bottom edges 56 of the sheets 41 are also supported by a central base member 58 according to this embodiment. The side edges 59 of the stack 40 are guided by upright vertical side plates 61 mounted on each of the L-shaped support plates 34. Normally, the spacing of the side plates 61 are adjusted to closely follow the edges 59 to insure accurate alignment of sheets 41 in the feeder 30.

The central base member 58 supports and guides a drive chain 60 interconnected with a backing plate assembly 62 that bears upon the upstream end 64 of the stack 40. The stack 40 is fed downstream according to the arrow 66 (FIG. 1) into a feeding mechanism 68 along the L-shaped support plates 34 and central base member 58 by downstream movement of the chain 60 and backing plate assembly 62.

Figures 8, 8A, 8B:
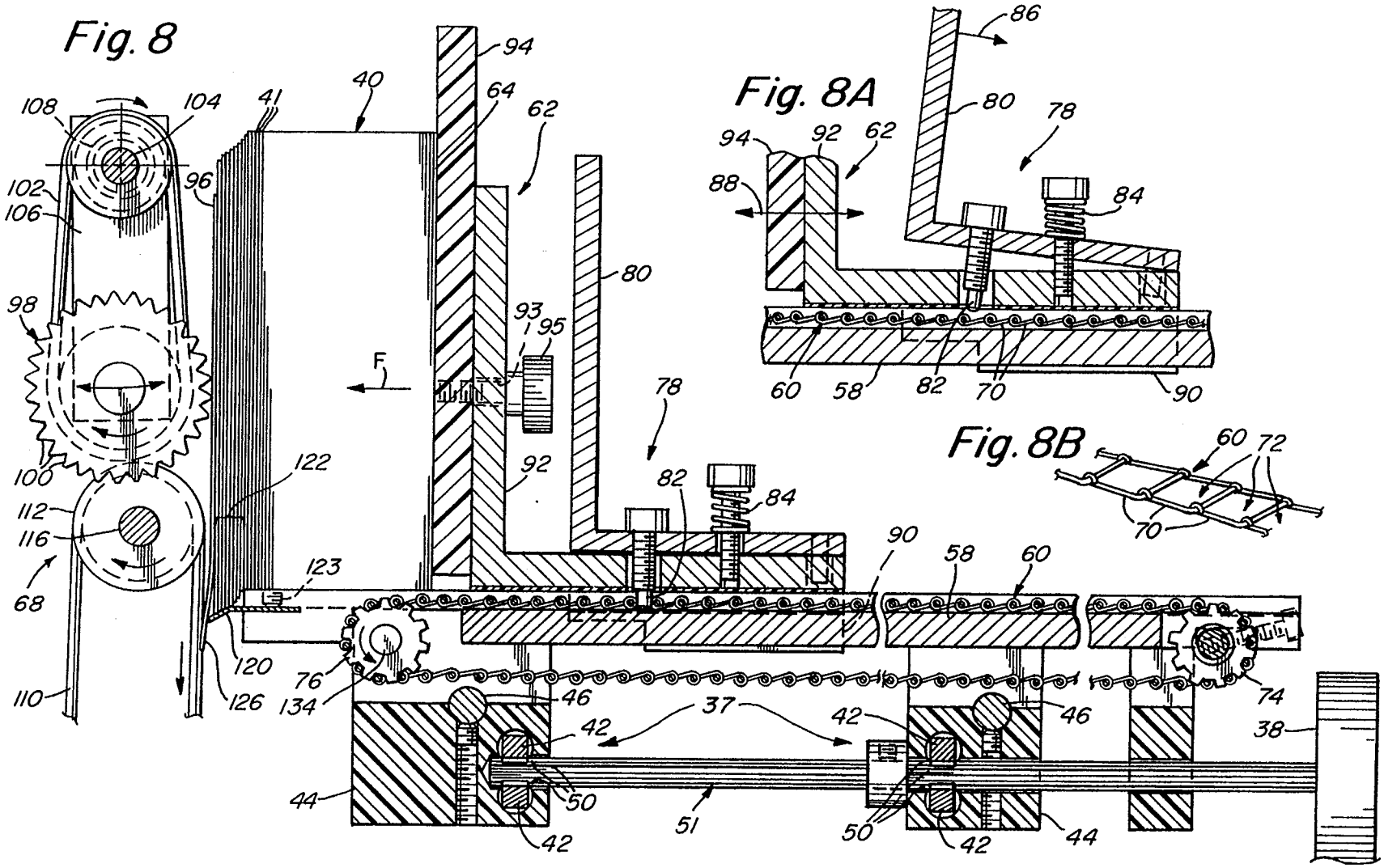
FIG. 8 is a more detailed cross-sectional side view of the singulator and drive members of the sheet feeder taken along line 8—8 of FIG. 5.
FIG. 8A is a partial cross-sectional side view of the backing plate-drive chain interlock mechanism for the sheet feeder according to this embodiment.
FIG. 8B is a more detailed partial perspective view of a backing plate drive chain according to one embodiment of this invention.

The control of drive chain 60 movement will be described further below. The drive chain 60 is itself detailed in FIGS. 3, 8, 8A and 8B. The chain 60 comprises, in this embodiment, a series of wire links 70 defining a substantially box-like shape about their interior 72 (FIG. 8B). The links 70 intermesh with a pair of rotating cogs 74 and 76 mounted at each of the upstream and downstream ends of the central base member 58 respectively. The backing plate assembly 62 is locked relative to the chain 60 by means of an interlock mechanism 78 (FIG. 8A) that includes a spring loaded lever 80 and a locking pin 82. The pin 82, in an engaged position as shown in FIG. 8, passes into one of the square chain-link interiors 72. It is, thus, captured by the chain 60 and moved downstream as the chain moves. Since the lever 80 is spring-loaded, mounted on a spring assembly 84, the pin 82 can be disengaged from the chain 60 by rotating the lever 80 as shown by the arrow 86 in FIG. 8A. When the pin 82 is disengaged, the backing plate assembly 62 is free to move upstream or downstream, as shown by the arrow 88, free of the chain 60. It should be noted that a plurality of stack drive and/or backing plate interlock mechanisms are contemplated according to this invention. Hence, the chain 60 and backing plate assembly 62 shown herein represent only one possible embodiment.

Figure 6:
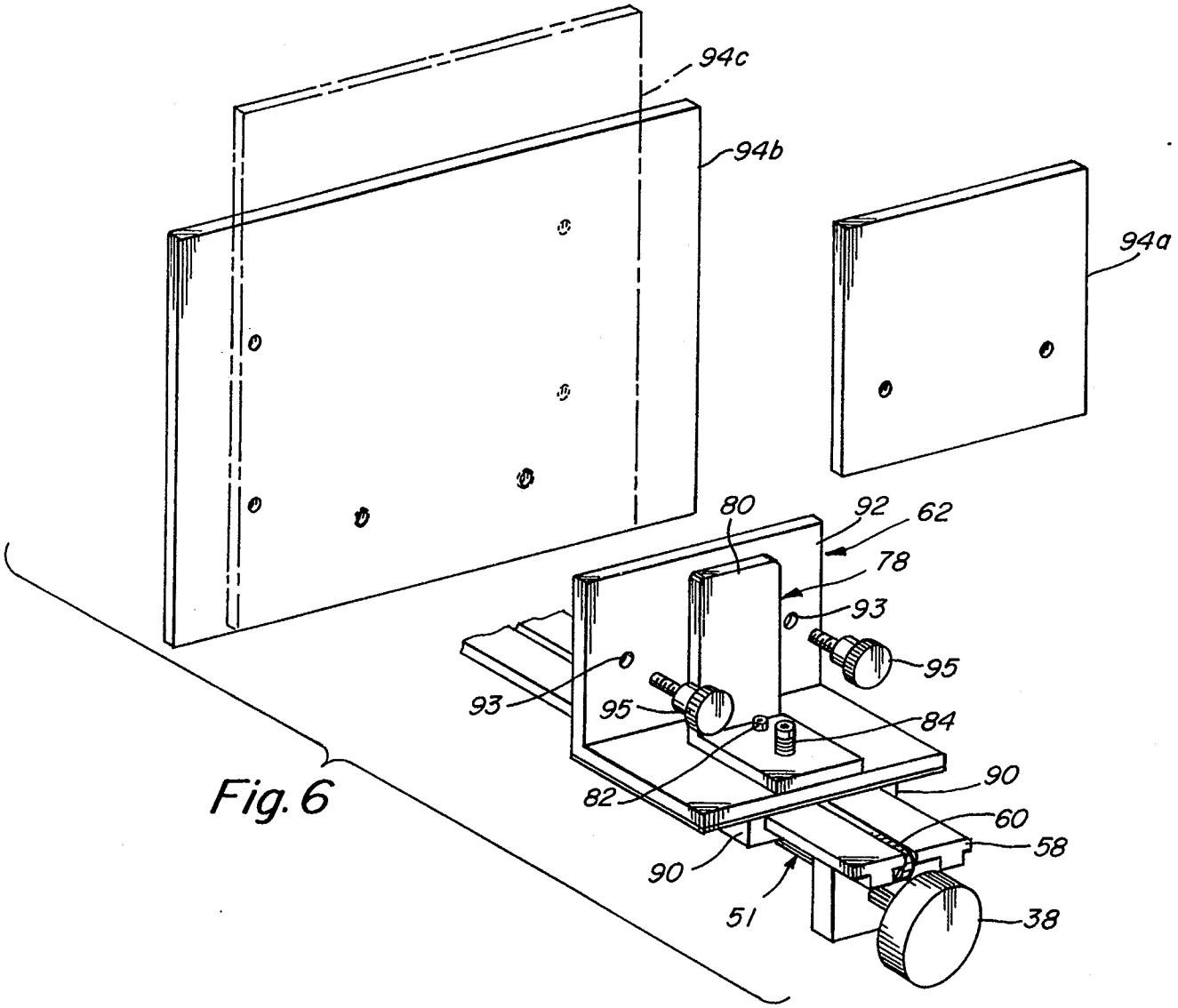
FIG. 6 is an exploded view of the backing plate of the sheet feeder according to this embodiment including several sized plates.
Figure 7:
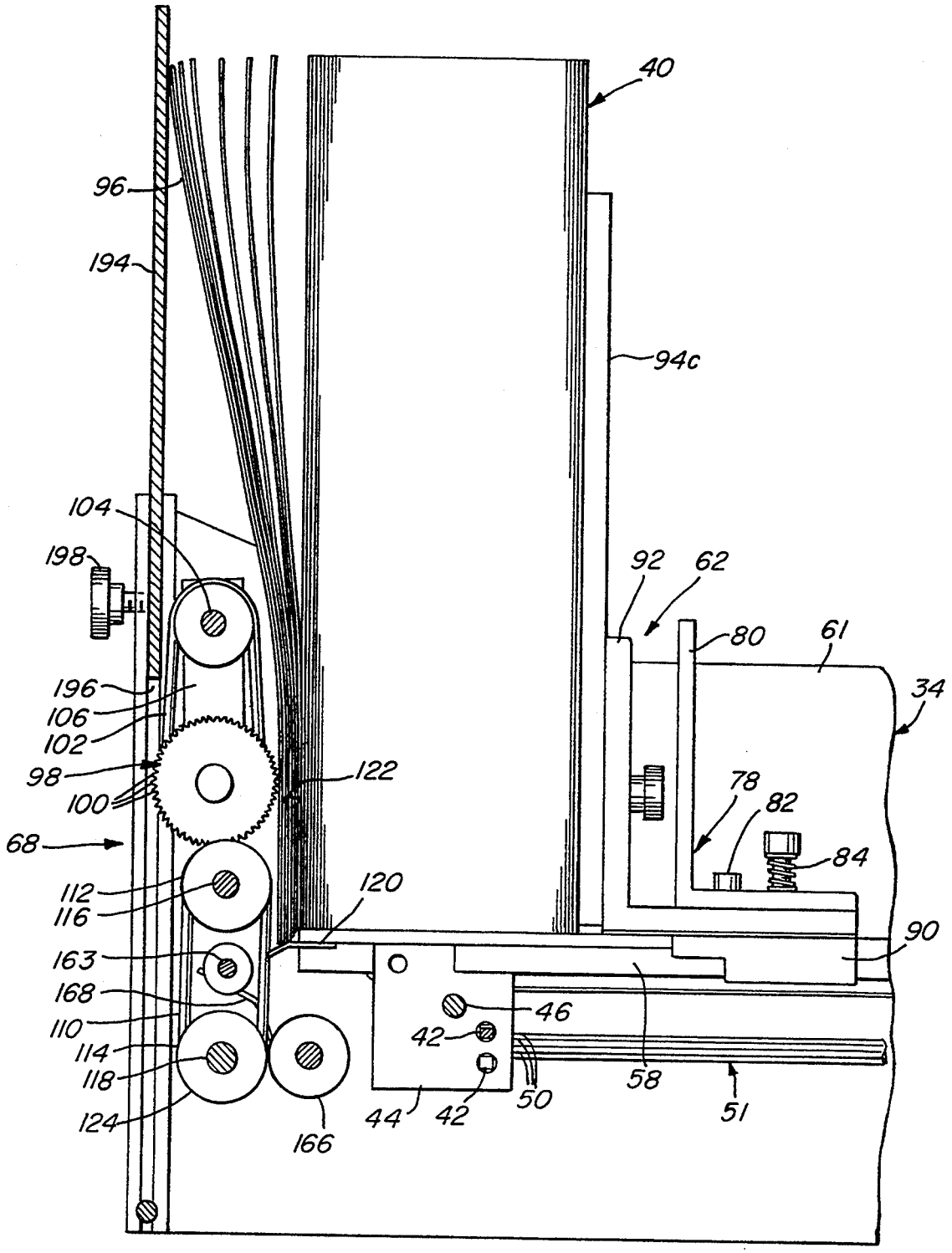
FIG. 7 is a partial cross-sectional side view of the sheet feeder according to this embodiment detailing the engagement of a stack of sheets with the singulator and drive members.

The backing plate assembly 62 further comprises horizontal guide blocks 90 that ride along the central base member 58 and an upright bracket 92. The upright bracket 92 includes holes 93 for receiving a pair of screws 95 according to this embodiment for securing an enlarged backing plate 94. FIG. 6 details a number of possible shapes for backing plates 94*a*, 94*b*, and 94*c* to the bracket. A given shape chosen, for example, from one of plates 94*a*, *b* or *c* can be utilized depending upon the length and width of the sheets in the stack.

Reference is now made to the feeding mechanism 68 according to this invention. As depicted in FIGS. 2, 3, 4, 7 and 8, the leading downstream sheet 96 in the stack 40 engages an elastomeric singulator wheel 98 that, in this example, includes serrations 100 to improve frictional interengagement with the sheet 96. The singulator wheel 98 contacts the face of the leading downstream sheet 96 and rotates to move the sheet downwardly toward a remote feeding location. The singulator wheel 98 is rotated by a belt 102 that is driven by a transverse drive shaft 104 positioned above the sheet 98. The singulator wheel 98 is supported by a bracket 106 that pivots to the drive shaft 104. The bracket 106 is interconnected with a hollow sleeve 108 that allows the drive shaft 104 to rotate while the sleeve 108 remains essentially stationary (See FIG. 4). The sleeve 108 can include bearings (not shown) to allow the shaft 104 to rotate relative thereto. The singulator wheel 98 in this embodiment can have a surface constructed of polyurethane or other suitable high friction materials to enhance gripping of sheets.

Positioned below the singulator wheel 82 are a set of frictional drive belts 110 that can have a circular cross-section according to this embodiment. The drive belts 110 can comprise an elastomeric material such as polyurethane. They are supported on grooved upper and lower sets of rollers 112 and 114 respectively. The belts are moved by a drive shaft 116 that is fixed to the upper rollers 112. As will be described further below, the lower rollers 114 freewheel relative to their shaft 118.

Figure 4:
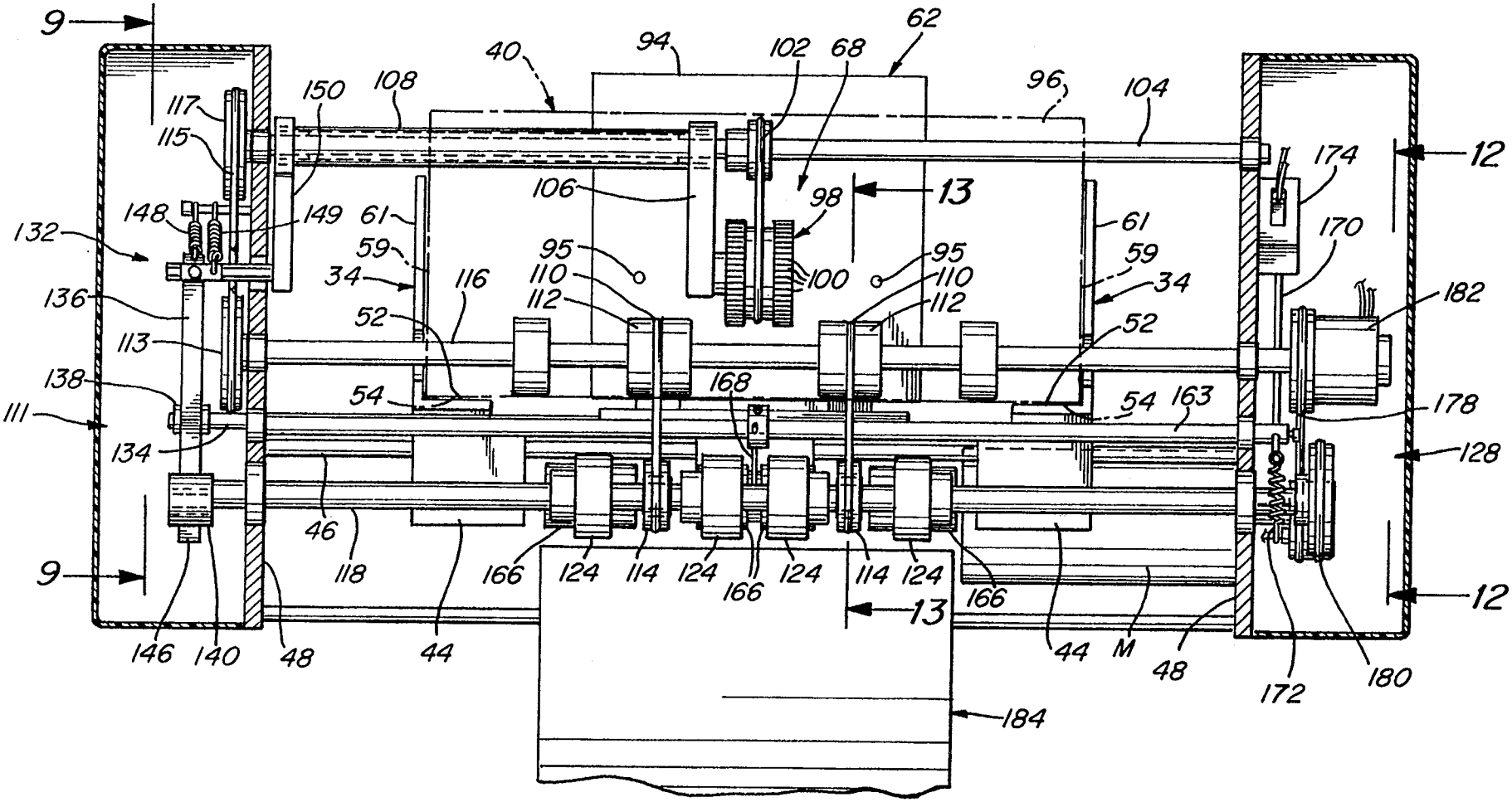
FIG. 4 is a cross-sectional front view of the sheet feeder taken along line 4—4 of FIG. 3.
Figure 9:
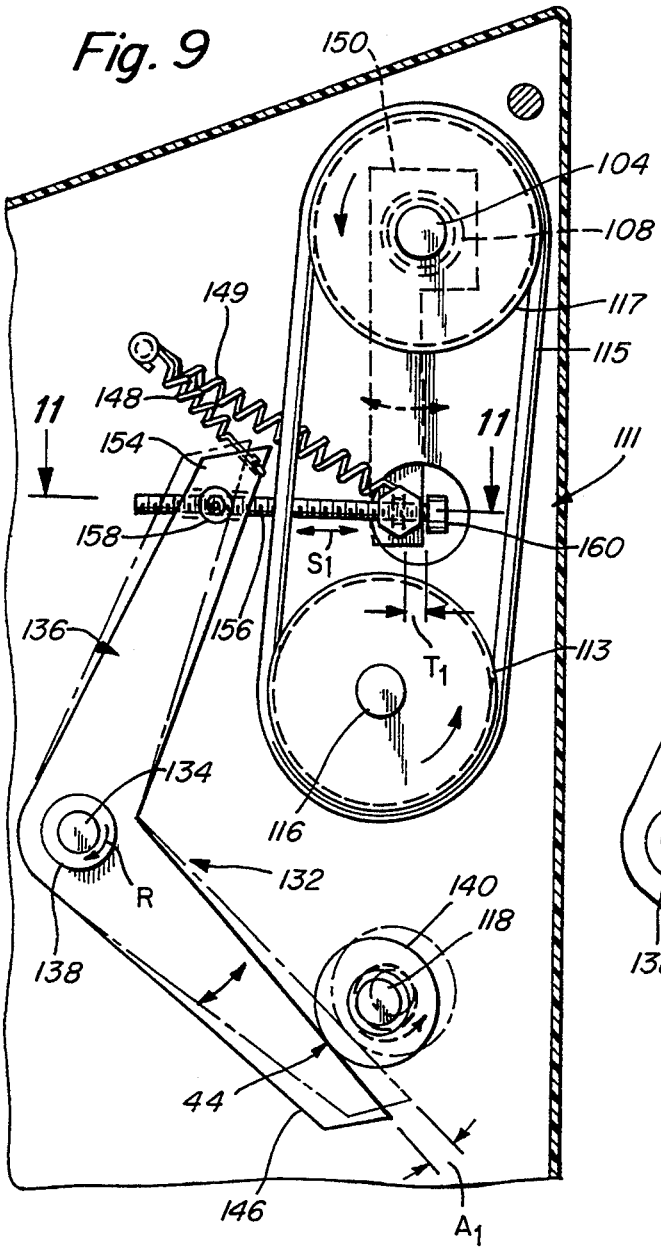
FIG. 9 is a partial cross-sectional side view of the backing plate advancing mechanism of the sheet feeder taken along line 9—9 of FIG. 4.
Figure 11:
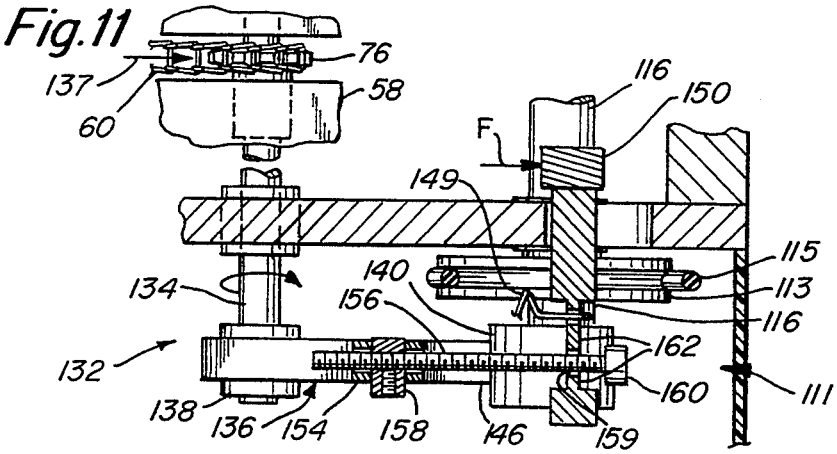
FIG. 11 is a partial top view of the mechanism taken along line 11—11 of FIG. 9.

The movement of the belts 110 is synchronized with movement of the singulator wheel 98 due to an interconnecting drive shaft 116 and wheel drive shaft 104. This interconnection is illustrated in FIGS. 4, 9 and 11 at the exposed right hand frame side 111 (refer to FIG. 1). The shaft 116 is connected to a pulley 113 that drives a belt 115. The belt 115 is connected with a second pulley 117 attached to the wheel drive shaft 104.

Figure 20:
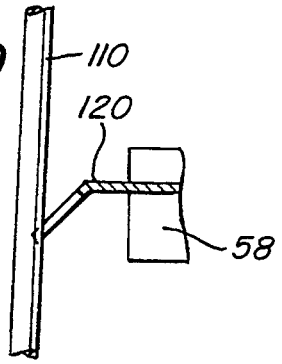
FIG. 20 is a partial cross-sectional side view of the interengagement between the drive belts and the singulation ramp.

The downstream most section of the central base member 58 includes a ramp 120 upon which the downstream most sheets 122 of the stack 40 are supported (See FIG. 8). The ramp 120 is angled downwardly, having an angle of between 35° and 45° relative to the bases horizontal plane. The exact angle is dependent upon the thickness of the sheets. For example, for thicker sheets an angle closer to 45°, as shown in FIG. 20, is preferred while thinner sheets (such as seven point stock) preferably require an angle closer to 35°. The ramp 120 in this example is removable by means of a set screw 123 (FIG. 8) to allow a plurality of differently sloped ramps (not shown) for different thickness sheets to be employed. The ramp 120 acts as a funnel to direct the leading downstream sheet 96 in the stack 40 into engagement with the drive belts 110.

The operational sequence of the feeding mechanism 68 will be described further below. In summary, singulation and driving of sheets comprises the rotation of the singulator wheel 98 at predetermined times in order to drive the leading sheet 96 off the edge of the ramp 120 and into the simultaneously rotating drive belts 110. The drive belts 110 then pull the sheet downwardly into a set of output drive rollers 124.

Figure 13:
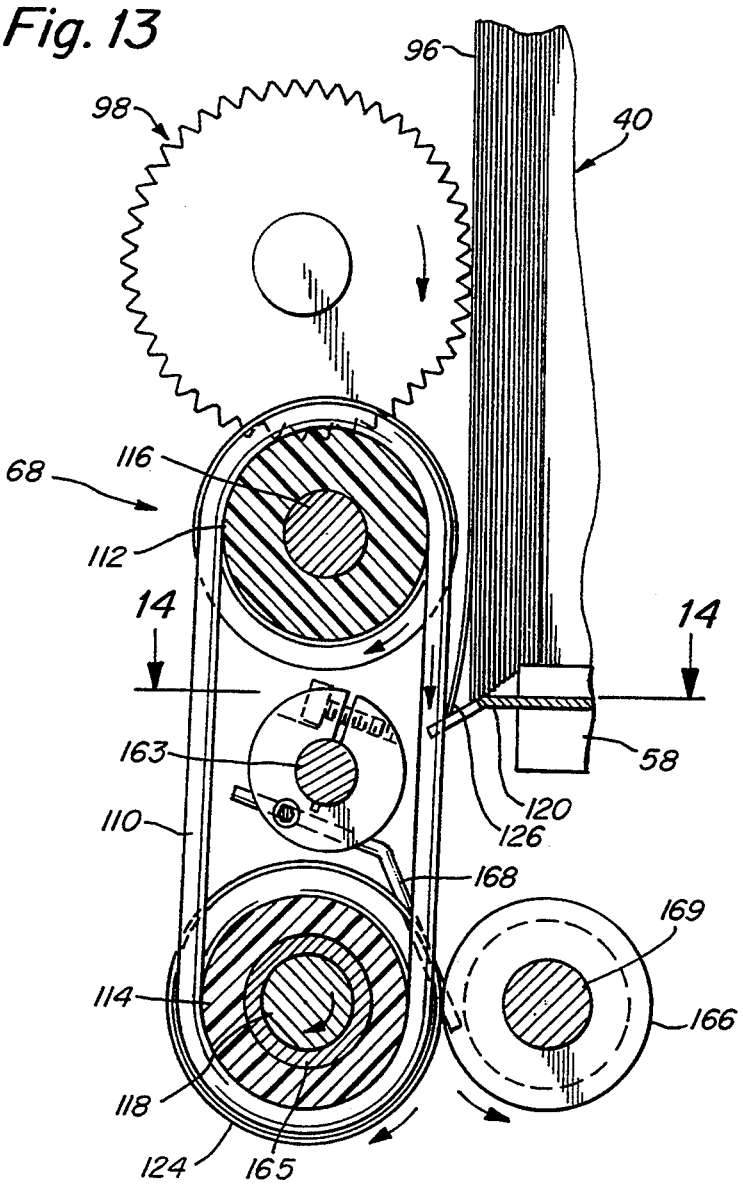
FIG. 13 is a cross-sectional side view detailing operation of the singulator and drive members of the sheet feeder taken along line 13—13 of FIG. 4.

As detailed in FIGS. 8 and 13, the ramp 120 provides a structure for separating the leading sheet 96 bottom edge 126 from more upstream bottom edges in the stack. The leading sheet bottom edge 126 tends to bend into the ramp 120 given downward pressure from the singulator wheel 98. The ramp 120 is sized so that the more upstream sheets in the stack 40 do not tend to flex with the leading sheet 96 as it is driven downwardly into the belts 110. Otherwise, two or more sheets would be driven simultaneously due to frictional interengagement between sheets. The angle and size of the ramp 120 is sufficient to overcome frictional interengagement such that only one sheet at a time is driven into the drive belts 110 by the singulator wheel 98.

The feeder 30 can be powered by a single motor according to this embodiment. This motor M is mounted in the left hand side 128 of the feeder (Refer to FIG. 1) as shown in exposed view in FIG. 12. The motor M acts to drive the feeding mechanism 68 and also to move the drive chain 60 via transversely mounted drive shaft 118.

Figure 10:
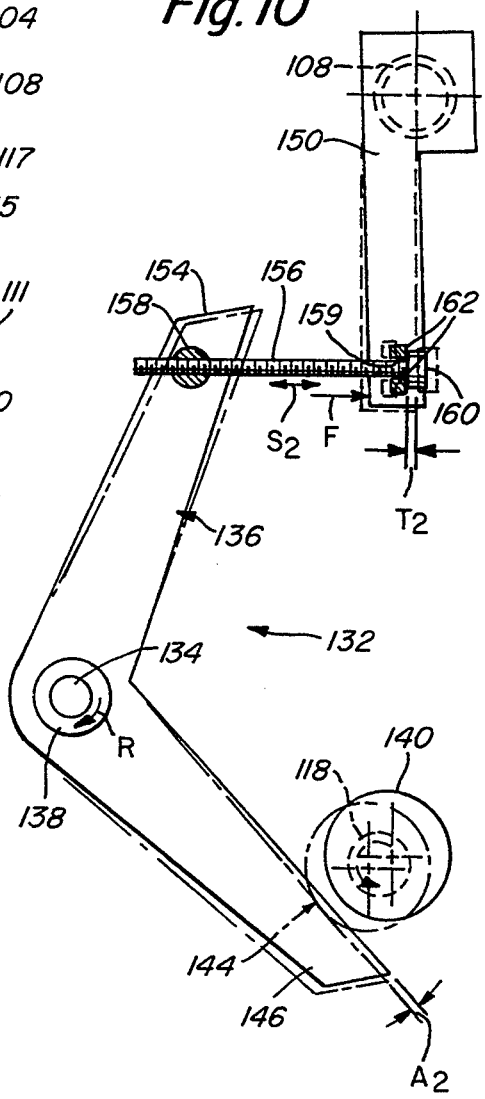
FIG. 10 is a more detailed side view of the mechanism of FIG. 9.

The control and movement of the drive chain 60 is further detailed in FIGS. 9–11. In this embodiment the right hand side of the frame 111 includes a drive chain advancing mechanism 132 which is exposed in FIGS. 9–11. The drive chain 60 is driven by the downstream cog 76 on the central base members 58 (See also FIG. 8). The cog 76 is interconnected by a shaft 134 to a V-shaped lever arm 136. The lever arm 136 includes a one-way bearing 138 that allows the cog 76 to rotate only in one direction relative to the shaft 134 so that rotation of the arm 136 can move the cog 76 only in the direction represented by the arrow R. Rotation of the cog 76 along the direction of the arrow R translates into downstream motion (the arrow 137 of FIG. 11) of the chain 60 and, hence, of the backing plate assembly 62. Rotary movement of the lever arm 136 is, itself, controlled by a rotating cam 140 interconnected by shaft 118 to the main drive motor M (via belt 180 in FIG. 12). Each time the eccentric surface 144 of the cam 140 passes over the lower end 146 of the arm 136, it causes the arm 136 to rotate in the direction of arrow R. This arm rotation moves the cog 76 by an equivalent angular displacement. The arm 136 includes a tension spring 148 at its upper end that returns the arm 136 to a rotating position following contact by the eccentric cam surface 144. The one way bearing 138 only allows the arm 136 to transfer motion to the cog 76 in the direction of arrow R. Hence, the return of the arm via the spring 148 (opposite R) is free of rotational connection with the cog 76.

Absent any limitation, the lever arm 136 rotates an equal distance as shown by displacement $A_1$ in FIG. 9 each time the cam 140 rotates one revolution. This would result in a basic incremental advance of the chain 60.

The disadvantage of such an incremental advance of the stack is that it does not account for the precise timing of feeding of sheets by the feeding mechanism. In order to effect reliable singulation of sheets, it is generally preferable for the leading sheet 96 to bear upon the singulator wheel 98 with a predetermined constant pressure. Too little pressure might prevent singulation, while too much pressure might result in the frictional bonding of upstream sheets to the leading sheet 96, causing the feeding of multiple sheets to the belts 110.

The singulator wheel 98 in this embodiment is, thus, mounted on a support bracket 106 that is, itself connected to an end of the tubular sleeve 108 that passes over the singulator wheel drive shaft 104 as described above. The other end of the tubular sleeve 108 is connected to a spring (149) loaded arm the "singulator wheel arm" 150 (FIGS. 4 and 9) that biases the singulator wheel 98 upstream toward the stack 40 within a given range of rotational movement. To control the precise pressure placed by the backing plate mechanism on the stack 40, and therefore, between the singulator wheel 98 and the stack 40, the V-shaped lever arm 136 according to this embodiment, includes a displacement limiting stop screw 156 that is directly connected with the singulator wheel arm 150.

As shown in FIG. 9, the lever arm 136, at its upper end 154, is attached to a stop screw 156 that is linearly fixed in a threaded bearing 158 relative to the lever arm 136. The screw 156 passes through a slightly oversized hole 159 in an extension of the spring loaded singulator wheel arm 150. The head 160 of the screw 156 bears upon the downstream face (hole shoulders) 162 of the singulator wheel arm 150. The bearing 158 can rotate slightly on the lever arm 136 to account for rotation of the lever arm 136 relative to the screw 156, but rotational translation of the lever arm 136 primarily results in linear translation of the screw 156 over a path defined by the arrow $S_1$. The linear displacement of the screw 156 is defined by the distance $T_1$. As shown in FIG. 9, without any pressure exerted on the singulator wheel 98, the spring 149 forces the singulator wheel 98 in an upstream direction to a maximum forward point. Hence, the cam eccentric displacement distance $A_1$ translates fully into chain cog 76 rotation. Absent any downstream displacing pressure on the singulator wheel 98 by the stack 40, the singulator wheel arm 150 does not interfere with the translation of the screw 156 over its entire possible distance $T_1$. This is because the screw head 160 does not engage the shoulders 162 of the hole 159 of the arm 150.

However, as shown in FIG. 10, if pressure in a downstream direction is exerted upon the singulator wheel 98 by the stack, it translates into rotational movement of the bracket 106 and the tubular sleeve 108 as illustrated by the arrow F. This movement causes engagement between the shoulders 162 of the singulator wheel arm hole 159 and the head 160 of the screw 156 which translates the lever arm 136 in the direction F. Thus, the lever arm 136 is pulled slightly away from the cam 140. As such, a smaller portion of the cam's eccentric surface 144 contacts the lever arm 136. As a result, a significantly smaller displacement $A_2$ is experienced by the lever arm 136. This smaller displacement translates into a correspondingly smaller linear displacement $T_2$ of the screw head 160 away from the singulator wheel arm 150. Since a much smaller lever arm 136 displacement occurs, the resulting chain 60 movement in the downstream direction is significantly smaller. The reduction in movement due to lifting of the lever arm 136 off the cam is most pronounced when a maximum force F is exerted by the stack 40 on the singulator wheel 98. The resulting displacement of the arm 150 brings the lever arm 136 substantially out of contact with the cam 140 and, hence, no further downstream driving of the stack 40 occurs. At this point, a maximum pressure upon the singulator wheel 98 by the stack 40 has been attained. Stack driving ceases so that no further pressure is built in between the leading sheet 96 and the singulator wheel 98.

The maximum pressure on the singulator wheel is relieved when the feeding mechanism 68 drives the leading sheet 96 out of the stack 40. At this time, the driven sheet leaves a slight gap between the next sheet in the stack and the singulator wheel 98. Hence, the spring 149 that is attached to the singulator wheel arm 150 causes the singulator wheel 98 (via rotation of the tubular sleeve 108 about the shaft 104) to move upstream against the next leading sheet in the stack. The gap creates a positive spacing between the screw head 160 and the shoulders 162 of the arm hole 159 causing the eccentric surface portion 144 of the cam 140 to contact the lever arm 136. The resulting contact of the lever arm 136 by the cam 140 causes the chain 60 to drive the stack 40 forward until a maximum pressure between the stack 40 and singulator wheel 98 has again been obtained and the lever arm 136 is completely out of contact with the cam 140. This next leading sheet is then driven by the singulator wheel 98 and the process of driving another leading sheet forward into the singulator wheel 98 to a point of maximum pressure continues.

Thus, by providing a system for advancing the backing plate drive chain 60 in small increments using a cam 140, the pressure of the stack's leading sheet upon the singulator wheel 98 can be relatively accurately controlled. The system depends upon incremental movement, so a certain degree of variation in pressure for each sheet occurs. However, by selecting the increments of movement at a small enough distance value, the pressure of the leading sheet on the wheel can be controlled within a very acceptable range. In this embodiment, a maximum chain advance increment of 1/32 of an inch (for a maximum value $T_1$) is preferable.

Further reference is now made to the feeding mechanism 68 and the control thereof. FIGS. 13–19 and 21 show in detail the sheet feeding process according to a preferred embodiment of this invention. As noted above, the leading sheet 96 in the stack 40 is drawn down the ramp 120 into the moving drive belts 110 by rotation of the singulator wheel 98. The singulator wheel 98 contacts the leading sheet 96 with a predetermined pressure that is maintained by the backing plate drive chain advancing mechanism 132 as described above.

Figure 14:
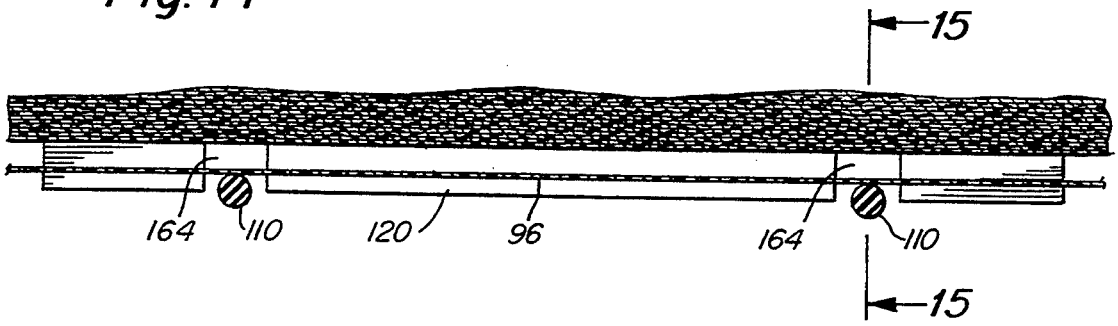
FIG. 14 is a partial cross-sectional top view of the singulation of a sheet taken along the line 14—14 of FIG. 13.

As shown in FIGS. 14 and 20, the drive belts 110 pass into the line of the edge of the ramp 120 in two slots 164 that provide clearance for the belts 110. The positional interrelationship between the belts 110 and the ramp 120 allow for a positive gripping of the leading sheet 96 as it is drawn from the stack 40. The leading sheet 96 is bowed between the slots 164 and the belts 110. As such, it is effectively singulated and removed from the remaining upstream stack 40.

Figure 15:
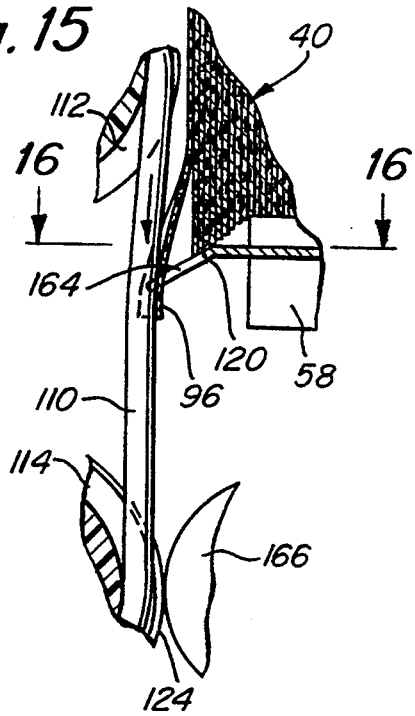
FIG. 15 is a more detailed partial cross-sectional side view of the singulation of a sheet taken along line 15—15 of FIG. 14.
Figure 16:
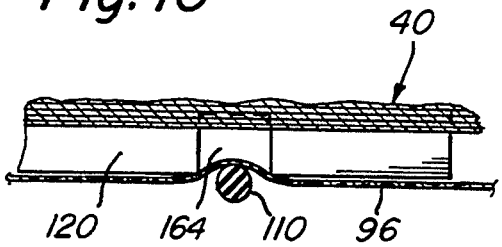
FIG. 16 is a partial cross-sectional top view of the singulated sheet of FIG. 15.

As shown in FIG. 15, once the leading sheet 96 has been driven by the singulator wheel 98 between the ramp 120 and the drive belts 110, it is gripped and engaged by the synchronized drive belts 110 and pulled downwardly thereby. Note that the overlapping of the belts 110 into the slots 164 of the ramp 120 causes the sheet 96 to flex as shown in FIG. 16. This flexure substantially increases the gripping pressure of the belts 110 upon the sheet 96 insuring a positive and slip-free drive by the belts 110.

Figure 17:
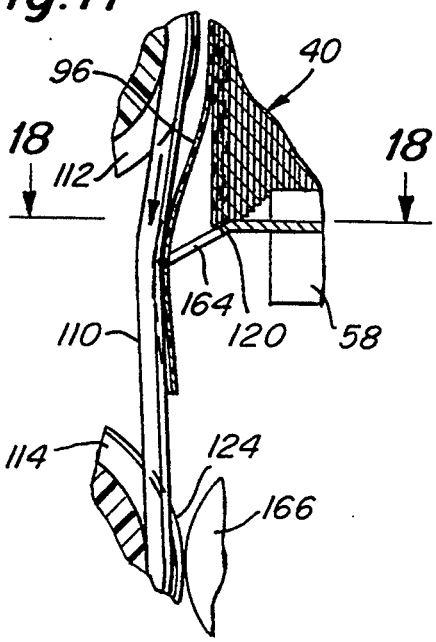
FIG. 17 is a more detailed partial cross-sectional side view of a sheet as it is driven from the stack downwardly through the drive belts of the singulator.
Figure 18:
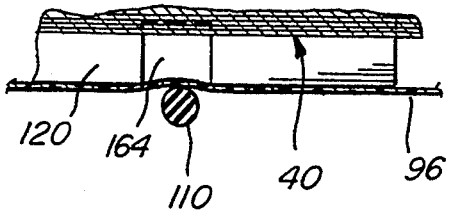
FIG. 18 is a partial cross-sectional top view of the driven sheet taken along line 18—18 of FIG. 17.

As the sheet 96 is further driven as depicted in FIG. 17, a greater surface area of belts 110 engage the sheet 96 and, hence, the natural rigidity of the web (paper for example) decreases the flexure about the slots 164 (See FIG. 18). A sufficient pressure is still applied to the sheet by the belts 110 and, in fact, is generally a greater degree of pressure than during initial grasping of the sheet 96 by the belts 110.

Figure 19:
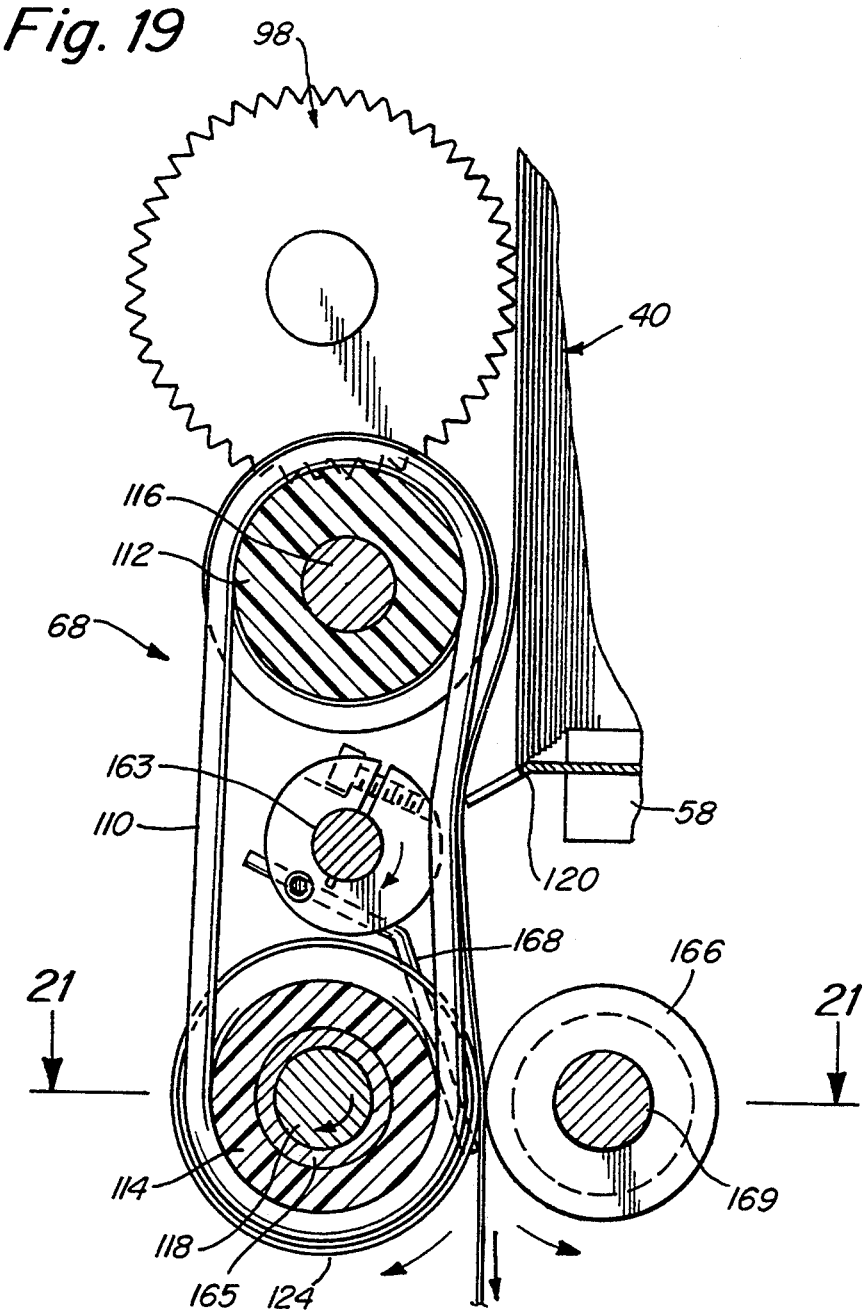
FIG. 19 is a cross-sectional side view of a sheet driven into the output drive rollers from the singular members.

FIG. 19 shows a sheet 96 that is almost fully driven through the feeding mechanism 68. At this point, the sheet 96 passes between the output drive rollers 124 and corresponding spring loaded pinch rollers 116. The output drive rollers 124 have a frictional surface such as polyurethane. The rollers 124 are mounted on the same shaft 118 as the lower belt rollers 114 (See FIG. 21). The lower belt rollers 114, as discussed above, freewheel relative to the shaft 118 on bearings 165 (FIGS. 13 and 19) and, thus, are not affected by rotation of this shaft 118 (rather the belts 110 are driven by the upper shaft 112 (FIG. 13)). The lower shaft 118 is rotationally fixed to the output drive rollers 124 and, thus, drives the output drive rollers 124.

The rollers 124 project toward the sheet 96 further than the belt rollers. Hence, the output drive rollers 124 and their pinch rollers 166 solely engage the lower end 126 of the sheet 96. At the point in which the lower end 126 enters the drive rollers 124, the sheet 96 is driven essentially by the output drive rollers 124. The drive rollers 124 grip the sheet 96 under pressure of the pinch rollers 166 that impinge upon an opposing face of the sheet 96. Note that the pinch rollers 166 are biased against the drive rollers 124 by compression springs 167 (FIGS. 12 and 21), located in the right and left frame sides 111, and 128 respectively, that bear upon the roller shaft 169.

The output drive rollers 124 move continuously at a preset speed throughout the operation of the device. The output drive rollers 124 can be geared to rotate faster than the singulator wheel 98 and belts 110. The driving mechanisms of the singulator wheel 98 and belts 110, can include one way clutch bearings (not shown) that allow these singulator elements to freewheel relative to their drive shafts when a sheet is output by the rollers 124 at a rate faster than the movement of the singulator elements.

Figure 12:
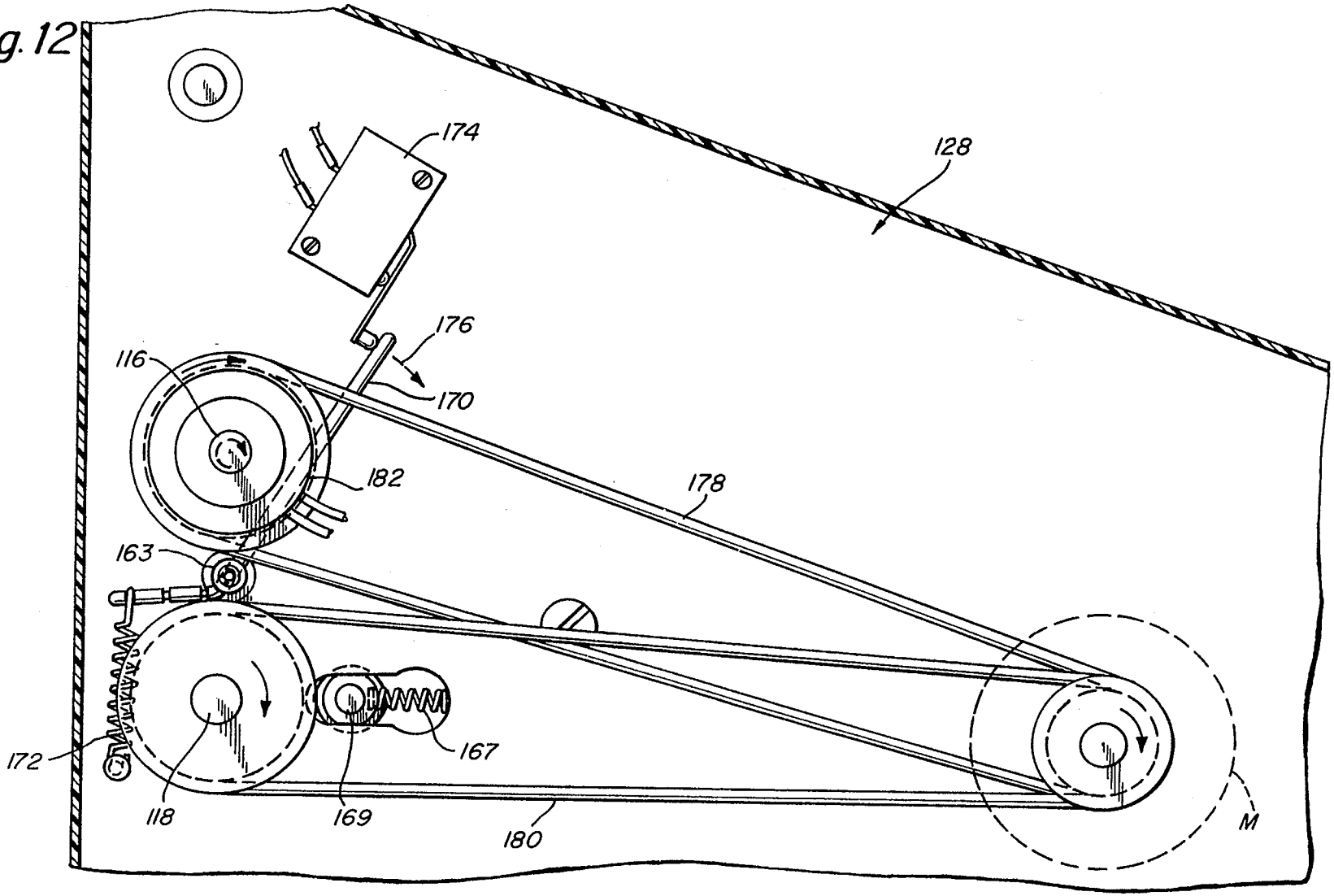
FIG. 12 is a cross-sectional side view of the singulator deactivation mechanism taken along line 12—12 of FIG. 4.
Figure 21:
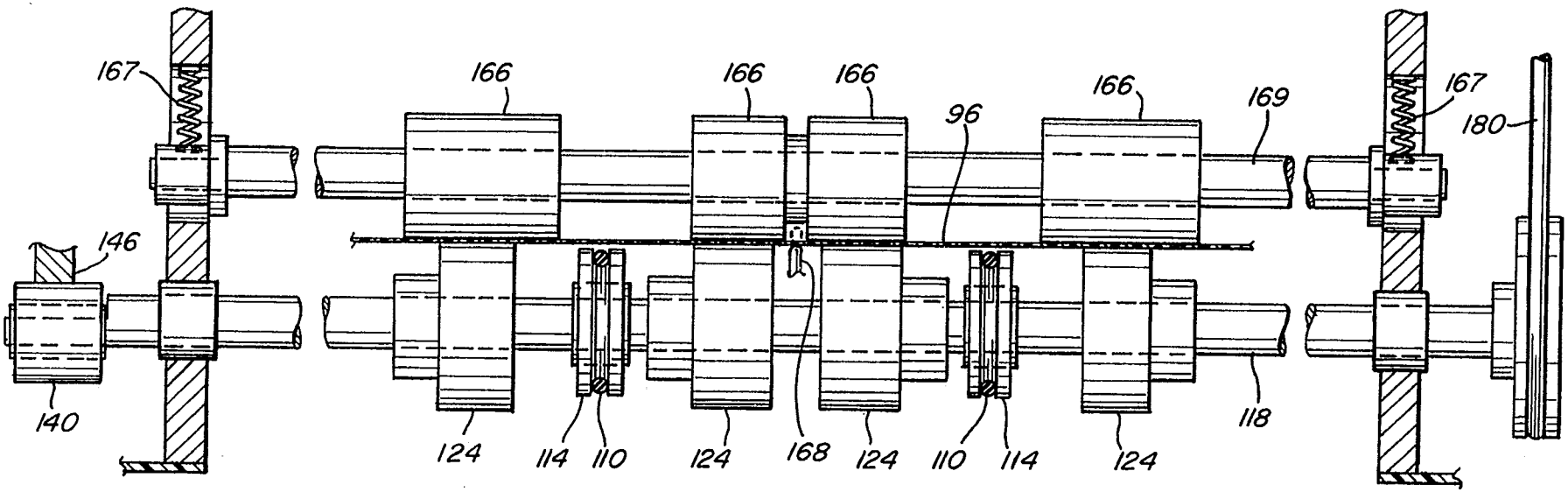
FIG. 21 is a partial cross-sectional top view of the drive belts and output drive rollers taken along line 21—21 of FIG. 19.

The sheet 96 in FIGS. 19 and 21 has rotated a sensing lever 168 that is normally located in the path of sheet travel as shown in FIG. 13. This lever 168 is interconnected via a shaft 163 with a corresponding lever 170 within the left side 128 of the frame as shown in FIG. 12. When the sheet 96 passes over the lever 168, the corresponding lever 170 on the left frame side 128 moves against the biasing force of a spring 172 away from a microswitch 174 in a direction shown by the arrow 176.

As discussed above, all elements of the apparatus can be driven by a single drive motor M. In this example as shown in FIG. 12, the drive motor M powers a pair of drive belts 178 and 180 that are interconnected with each of the belt drive shaft 116 and the output drive roller shaft 118. The lower shaft 118 rotates the output drive rollers 124 continuously, as discussed above, and is fixedly connected to these rollers. The upper shaft 116, which powers the singulator wheel 98 and driving belts 110, is interconnected with an electrically powered clutch 182. Deactivating the microswitch 174 causes the clutch 182 to disengage, hence allowing the shaft 116 to freewheel relative to the motor M. As such, the singulator wheel 98 and belts 110 are depowered and the sheet 96 is driven solely by the output drive rollers 124 and pinch rollers 166.

The belts 110, as discussed above, can freewheel relative to the shafts 116 and 118 in a sheet driving direction via one way bearings. Thus, the sheet is pulled the rest of the way through the belts 110 by the rollers without resistance from the belts 110. A new leading sheet is not driven down the ramp 120 into the drive belts 110 by the singulator wheel 98 until the preceding sheet has cleared the sensing lever 168 and output drive rollers 124. Thus, each sheet fed through the feeding mechanism can proceed individually without overlapping another sheet. Each time a sheet passes out of the feeder, the sensing lever 168 again triggers the microswitch 174 to engage the clutch causing the singulator 98 and drive belts 110 to again rotate.

While a rotating sensing lever 168 and microswitch 174 are utilized as clutch trip switches according to this embodiment, a variety of sheet edge sensing elements can be employed according to this invention. For example, an ultrasonic or optical sensor can be utilized to activate and deactivate the clutch 182. Additionally, more than one motor can be utilized to drive different elements, thus, eliminating the need for a clutch.

The sheets output from the feeding mechanism can be directed to a stacking location or another sheet utilization point by means of a chute or ramp 184 as shown in FIG. 3. The ramp 184 in this example is adjustable to allow direction of sheets away from or back underneath the device based upon the orientation of the ramp as illustrated by the arrow 186. In a stacking embodiment such as that described above, in which the sheets are individually directed to a point without overlap, the direction of the ramp outwardly from the device will result in an order of stacking that is reversed from that in the initial stack 40. Alternatively, directing the ramp underneath the device enables stacking in the same order as the fed source stack 40.

Figure 22:
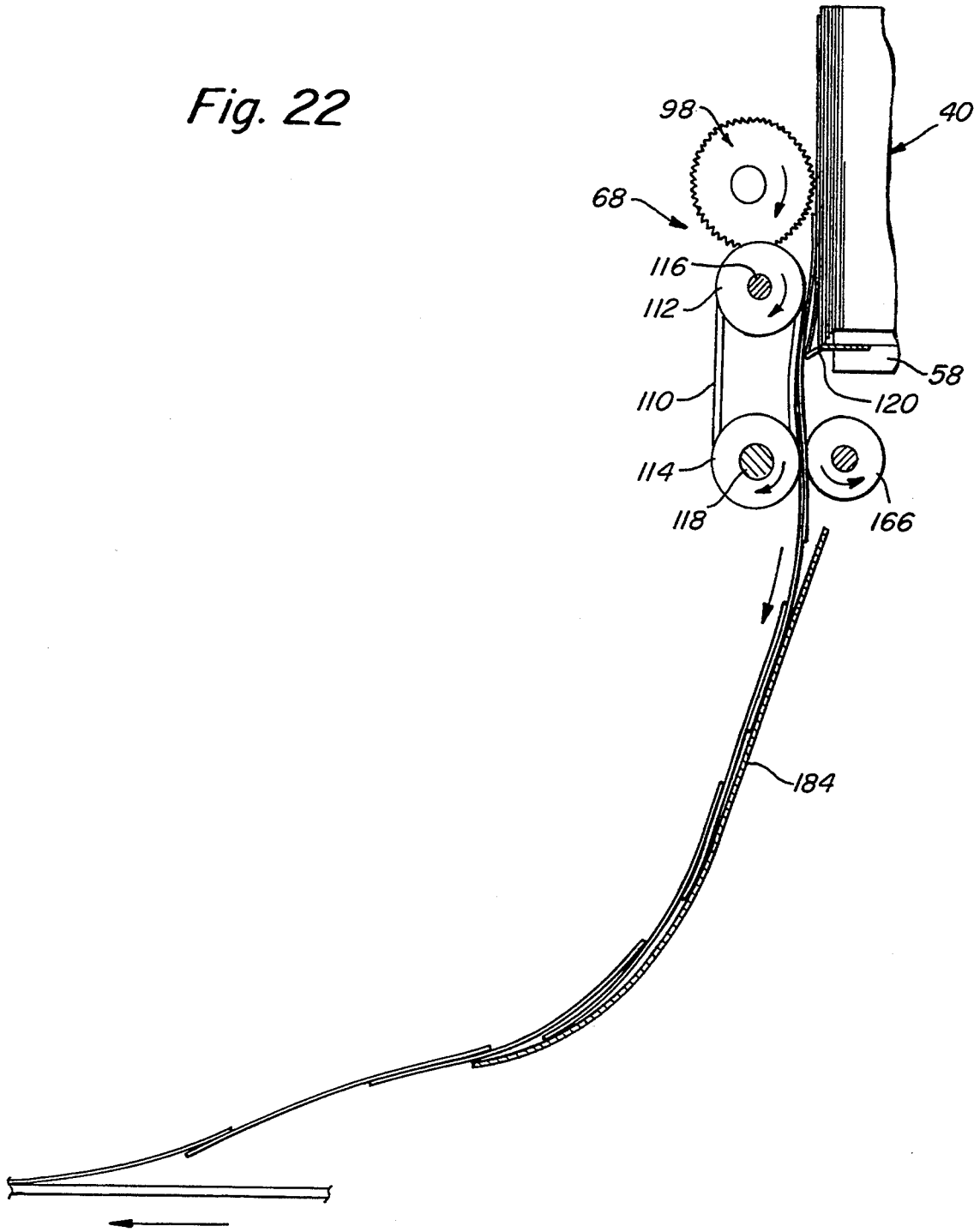
FIG. 22 is a cross-sectional side view of the feeding of overlapping sheets with the singulator and output drive rollers running synchronously.

While singulation of sheets is desirable in certain applications, it may be desirable to feed a stack of sheets in overlap fashion. In order to accomplish overlap feeding, it is necessary to power all driving elements (the singulator wheel 98, drive belts 110, and output drive rollers 124) at once and at a somewhat similar speed. FIG. 22 illustrates an overlap feeding embodiment according to this invention. All feeding mechanism elements are rotated simultaneously as indicated by the arrows. Thus, each time a sheet clears the singulator wheel 98, the next sheet is immediately engaged by the rotating wheel surface brought down the ramp 120 into engagement with the belts 110. Enough pressure is exerted by the singulator wheel 98 to drive the sheet downwardly until the belts 110 can engage it fully. Simultaneously, as described above, the gap between the next leading sheet and singulator wheel created by the exiting sheet results in reduced pressure on the singulator wheel 98. The stack 40 is, thus, moved incrementally downstream to fill the gap.

The generation of an overlapping sheet output is accomplished according to this embodiment by overriding the microswitch 174 (FIG. 12) and operating the clutch 182 so that it continuously engages with the drive motor M. Hence, the singulator wheel 98 and drive belts 110 will operate continuously in the same manner as the output drive rollers 124. Such override can be accomplished by a frame mounted control switch 188 such as that shown in FIG. 1. Device controls can also include a drive motor speed control 190 and a power on/off switch 192. Fuses and circuit breakers for preventing overload as well as jam detectors (not shown) are also contemplated according to this invention. Such elements can disable the drive motor and/or sound an alarm if a feeding problem develops.

Additional features for supporting the stack can also be utilized. For example, FIG. 7 details a removable support plate 194 for preventing tall leading sheets 96 in the stack 40 from drooping over the drive mechanism. This plate 194 is mounted in slots 196 (FIGS. 1–2) and is secured in the slots 196 by screws 198.

The preceding has been a detailed description of a preferred embodiment. Various modifications and additions can be made without departing from the spirit and scope of this invention. Accordingly, this description is meant to be taken only by way of example and not to otherwise limit scope of the invention.

What is claimed is:

1. A high speed sheet feeder comprising:

a support platform for supporting a stack of sheets, faces of the sheets being substantially transverse to the support platform;

a singulator engaging the face of a leading sheet in the stack for driving the sheet out of the stack;

a backing support for engaging an upstream most sheet in the stack;

a drive member for advancing the backing support in a downstream direction to drive the stack pressurably toward the singulator, the drive member advancing the backing support in predetermined length increments;

a linkage interconnected to the drive member and movable in response to each of increased pressure and decreased pressure by the leading sheet on the singulator;

a reciprocating element, mechanically interconnected to the drive member, that applied a reciprocating force to the drive member, each application of the reciprocating force corresponding to an advancing of the backing support a predetermined length increment; and each of the linkage and the drive member being interconnected so that movement of the linkage varies an interconnection period of the reciprocating element to the drive member over a substantially continuous range of interconnection periods so that the predetermined length increments are varied relative to each of the increase and the decrease of pressure by the leading sheet upon the singulator.

2. A high speed sheet feeder as set fourth in claim 1 wherein the support platform comprises a pair of walled members having vertical faces and horizontal faces for engaging each of the side edges and bottom edges of the stack, the walled members having means for moving toward and away from each other to selectively accommodate narrower and wider sheets, respectively.

3. A high speed sheet feeder as set forth in claim 2 wherein the means for moving comprises a pinion gear and rack attached to each of the supports and engaging diametrically opposed sides of the pinion gear so that rotation of the pinion gear causes the racks to move in opposite directions relative to one another.

4. A high speed sheet feeder as set forth in claim 1 further comprising a pair of drive belts positioned adjacent the singulator and engaging sheets driven by the singulator thereinto, the belts moving in synchronization with the singulator.

5. A high speed sheet feeder as set forth in claim 4 further comprising a ramp angled downwardly away from the stack and positioned proximate the belts, the ramp being sized and arranged to guide the leading downstream sheet driven by the singulator into the belts.

6. A high speed sheet feeder as set forth in claim 5 wherein a downstream most edge of the ramp is aligned with the belts, the edge including a pair of slots and the belts being positioned within the slots so that sheets driven there between are curved between the belts and the slots.

7. A high speed sheet feeder as set forth in claim 6 wherein the ramp is angled, relative to a horizontal plane formed by the support platform at an angle in a range of approximately 35°–45°.

8. A high speed sheet feeder as set forth in claim 7 further comprising output drive rollers positioned proximate and downstream of the belts, the output drive rollers engaging a leading edge of sheets transferred from the belts thereinto.

9. A high speed sheet feeder as set forth in claim 8 further comprising means for operating each of the singulator and the drive belts and the output drive rollers individually.

10. A high speed sheet feeder as-set forth in claim 9 wherein the means for operating includes a sensor for sensing the presence of a sheet proximate the output drive rollers, the sensor including means for signalling the singulator and the drive belts to cease operation while the output drive rollers continue operating.

11. A high speed sheet feeder as set forth in claim 10 further comprising a central drive motor for operating each of the singulator and the drive belts and the output drive rollers.

12. A high speed sheet feeder as set forth in claim 11 wherein the means for operating further includes a clutch, responsive to the sensor, for disengaging the central drive motor from the singulator and the drive belts in response to the presence of a sheet at the output drive rollers.

13. A high speed sheet feeder as set forth in claim 12 further comprising a sensor override control to prevent disengagement of the clutch so that each of the singulator and the drive belts and the output drive rollers operate simultaneously to generate an overlapping output of sheets.

14. A high speed sheet feeder as set forth in claim 1 wherein the drive member comprises a drive chain having openings therein and the backing support comprises a support plate having a pin for engaging one of the openings of the drive chain.

15. A high speed sheet feeder as set forth in claim 14 wherein the pin is removable to move the backing support relative to the drive chain.

16. A high speed sheet feeder as set forth in claim 1 further comprising a drive motor interconnected to the reciprocating element and also interconnected to the singulator wherein a movement of the singulator to drive a sheet out of the stack causes the reciprocating element to move through at least one complete cycle of reciprocation.

17. A high speed sheet feeder comprising:

a support platform for supporting a stack of sheets, faces of the sheets being substantially transverse to the support platform;

a singulator engaging the face of a leading sheet in the stack for driving the sheet out of the stack;

a backing support for engaging an upstream most sheet in the stack;

a drive member for advancing the backing support in a downstream direction to drive the stack pressurably toward the singulator;

a lever arm interconnected with a drive wheel engaging the drive member, the lever arm transmitting a predetermined length increment of movement to the drive member in response to rotational movement of the lever arm, wherein the drive member is advanced in predetermined length increments; and means, responsive to pressure exerted on the singulator by the face of the leading sheet in the stack, for varying the length of the predetermined length increments, the length of the increments being increased in response to decreased pressure by the leading sheet on the singulator and the length of the increments being increased in response to a decrease in pressure by the leading sheet on the singulator.

18. A high speed sheet feeder as set forth in claim 17 wherein the singulator includes a movable support bracket for allowing the singulator to move in response to pressure exerted thereon by the stack and the means for varying includes a linkage interconnected with the support bracket and responsive to movement thereof, the linkage being interconnected with the lever arm so that translation of the singulator based upon increased pressure from the stack decreases a range of movement of the lever arm so as to decrease the size of the length increments.

19. A high speed sheet feeder as set forth in claim 18 wherein the means for varying further comprises an eccentric cam having an eccentric surface that engages the lever arm to rotate the lever arm during a predetermined angle of rotation thereof.

20. A high speed sheet feeder as set forth in claim 19 wherein the linkage further comprises a stop that rotates the lever arm a predetermined distance away from the cam in response to a predetermined translation of the singulator by the stack so that the eccentric surface of the cam engages the lever arm over a smaller angular distance thereof.

21. A method for feeding sheets comprising the steps of:

supporting a stack of sheets so that a downstream most sheet face engages a singulator and an upstream most sheet face engages a backing support;

advancing the backing support in a downstream direction so that the downstream most sheet in the stack engages the singulator under pressure;

controlling the step of advancing so that advance of the backing support occurs in predetermined length increments, the step of controlling including providing a reciprocating periodic displacement force for predetermined time increments to a drive member of the backing support to advance the backing support by corresponding predetermined length increments; and varying the length of the predetermined length increments based upon the pressure exerted by a leading sheet in the stack on the singulator, a length of the increments being increased in response to decreased pressure by the leading sheet on the singulator and a length of the increments being decreased in response to increased pressure.

22. A method as set forth in claim 21 wherein the step of varying further comprises changing a length of the predetermined length increment in proportion to a movement of the singulator under pressure of the leading sheet in the stack.

23. A method as set forth in claim 22 wherein the step of advancing includes providing a periodic displacement to the backing support to advance the backing support downstream, a time increment of the periodic displacement being varied in response to movement of the singulator so as to vary the length increment.

24. A method as set forth in claim 21 further comprising singulating leading sheets in the stack to drive the sheets out of the stack individually.

25. A method as set forth in claim 24 wherein the step of singulating includes driving a leading sheet in the stack with a singulator sheet that engages a face of the leading sheet into a plurality of simultaneously moving belts.

26. A method as set forth in claim 25 wherein the step of singulating further comprises providing a downwardly sloping ramp that directs bottom edges of a leading sheet in the stack driven by the singulator wheel into the belts while more upstream sheets are maintained remote from the belts.

27. A method as set forth in claim 26 further comprising varying an angle of the ramp in a downward sloping direction based upon the thickness of the sheets.

28. A method as set forth in claim 27 further comprising providing output rollers adjacent a downstream most portion of the belts, the output rollers rotating to drive the sheets further downstream from the stack.

29. A method as set forth in claim 28 further comprising detecting the presence of a leading edge of the sheet proximate the output rollers, the step of detecting including signaling the singulator wheel and the belts to cease operation until the sheet has passed downstream substantially fully through the output rollers.

30. A method as set forth in claim 21 further comprising singulating sheets out of the stack wherein the step of singulating occurs in conjunction with the step of advancing so that a singulation of a sheet occurs in conjunction with the providing of at least one reciprocating periodic displacement force increment to the drive member of the backing support.

31. A method for feeding sheets comprising the steps of:

supporting a stack of sheets so that a downstream most sheet face engages a singulator and an upstream most sheet face engages a backing support;

advancing the backing support in a downstream direction so that the downstream most sheet engages the singulator under pressure;

controlling the step of advancing so that advance of the backing support occurs in predetermined length increments;

varying a length of the predetermined length increments in proportion to movement of the singulator based upon the pressure exerted by the downstream most sheet on the singulator, a length of the increments being increased in response to decreased pressure by the downstream most sheet on the singulator and a length of the increments being decreased in response to increased pressure by the downstream most sheet on the singulator; and wherein the step of advancing includes providing a periodic displacement to the backing support to advance the backing support downstream, a time interval of the periodic displacement being varied in response to a movement of the singulator under the pressure of the downstream most sheet so as to vary the predetermined length increments, the step of providing a periodic displacement to the backing support further including providing an eccentric cam and a lever arm interconnected therewith, the lever arm being further connected with the backing support and the time interval of the periodic displacement being based upon contact with the lever arm by the cam.

32. A high speed sheet feeder comprising:

a support platform for supporting a stack of sheets having faces substantially transverse to the support platform;

a singulator, movably mounted relative to the support platform and engaging the face of a leading sheet in the stack, the singulator rotating to drive the sheet out of the stack;

a movable backing support slidably mounted on the support platform to advance downstream on the support platform in predetermined length increments to bias the downstream face of the stack against the singulator so as to cause movement of the singulator thereby; and a linkage, interconnected between the singulator and the backing support, for varying of the length increments based upon the downstream movement of the singulator by the stack, the length increments being maximum when the singulator is positioned in an upstream most position and the length increments approaching zero when the singulator is in a downstream most position and the increments having a length between the maximum and zero when the singulator is positioned between the upstream most portion and the downstream most portion, the linkage including a drive member that provides a reciprocating displacement force at periodic time intervals and a drive arm that is engaged by the drive member, the linkage varying a position of the drive arm relative to the drive member to vary a period of engagement of the drive arm by the drive member in order to vary a length of the length increments.

33. A high speed sheet feeder as set forth in claim 32 wherein the drive member includes a linkage that provides at least one period of engagement of the drive arm by the drive member relative to one rotation of the singulator to drive a sheet out of the stack.

34. A high speed sheet feeder as set forth in claim 33 further comprising a drive motor interconnected with each of the drive member and the singulator.

35. A high speed sheet feeder as set forth in claim 32 wherein the drive member comprises a rotating eccentric cam.

36. A high speed sheet feeder as set forth in claim 35 wherein the singulator includes a bracket having a pivot wherein engagement of the face of the leading sheet in the stack with the singulator causes the pivot to rotate, the pivot being interconnected with the linkage to change a distance of the drive arm relative to the drive member.

37. A high speed sheet feeder as set forth in claim 36 wherein the bracket includes a spring that biases the singulator in an upstream direction and wherein engagement of the face of the leading sheet in the stack with the singulator overcomes a biasing force of the spring.

38. A method for feeding sheets comprising:

supporting a stack of sheets with edges of the sheets supported on a supporting surface and a downstream most sheet engaging a singulator and an upstream most sheet engaging a backing support;

driving the backing support downstream in predetermined length increments so as to drive the stack of sheets downstream, the step of driving including providing a reciprocating drive member that engages and imparts a periodic displacement force to a drive linkage that is interconnected with the backing support; and varying an engagement period of the drive linkage with the drive member based upon an engagement pressure of the singulator by the downstream most sheet of the stack to vary a length of the predetermined length increments wherein an increase of engagement pressure of the downstream most sheet on the singulator causes a decrease in the length of the predetermined length increments and a decrease of the engagement pressure by the downstream most sheet on the singulator causes an increase in the length of the predetermined length increments.

39. A method as set forth in claim 38 further comprising providing a mechanical interconnection between the singulator and the drive linkage to change a distance of the linkage relative to the drive member.

40. A method as set forth in claim 39, wherein the step of driving further comprises engaging the backing support with a flexible drive member that translates a rotary motion of the drive linkage into a linear motion in the flexible drive member.

41. A method as set forth in claim 40, further comprising detachably engaging the backing support with the flexible drive member so that the backing support is relocatable relative to the flexible drive member.

42. A method as set forth in claim 41, wherein the step of providing a reciprocating drive member includes providing a rotating cam shaped surface that rotates eccentrically relative to an axis of rotation thereof.

43. A method as set forth in claim 41, wherein the step of providing a mechanical interconnection further comprises providing a drive linkage having an arm that engages the cam for a predetermined time interval and wherein the step of varying includes moving the arm relative to the cam so that the predetermined time interval is varied.

* * * * *